US006032500A

United States Patent [19]

Collard, Jr. et al.

[11] Patent Number: 6,032,500

[45] **Date of Patent: *Mar. 7, 2000**

[54] KIT FOR RETROFITTING A DOOR WITH A SECURITY LOCK SYSTEM

[75] Inventors: Thomas H. Collard, Jr.; Larry D. Pechacek, both of San Antonio, Tex.

[73] Assignee: Stephen C. Cohen, San Antonio, Tex.

[ * ] Notice: This patent is subject to a terminal disclaimer.

[21] Appl. No.: 09/221,525

[22] Filed: Dec. 28, 1998

Related U.S. Application Data

[63] Continuation-in-part of application No. 08/844,030, Apr. 18, 1997, Pat. No. 5,852,944.

[51] Int. Cl.[7] ..... E05B 49/00

[52] U.S. Cl. ..... 70/278.1; 292/144; 70/107; 70/280

[58] Field of Search ..... 70/278.1, 279.1, 70/280, 107, 277, 256, 257, 286.1; 292/144, 35, 36

[56] References Cited

U.S. PATENT DOCUMENTS

| | | | |
|---|---|---|---|
| 580,820 | 4/1897 | Scheeren . | |
| 3,751,088 | 8/1973 | Schlage et al. . | |
| 3,792,888 | 2/1974 | Kambic . | |
| 3,893,723 | 7/1975 | Boule . | |
| 3,907,343 | 9/1975 | Goodwin . | |
| 4,109,494 | 8/1978 | Allemann . | |
| 4,211,443 | 7/1980 | Butts et al. . | |
| 4,509,093 | 4/1985 | Stellberger . | |
| 4,509,347 | 4/1985 | Young . | |
| 4,563,886 | 1/1986 | Kletzmaier et al. . | |
| 4,640,108 | 2/1987 | Young . | |
| 4,677,834 | 7/1987 | Hicks . | |
| 4,685,709 | 8/1987 | Kambic . | |
| 4,691,584 | 9/1987 | Takaishi et al. . | |
| 4,907,429 | 3/1990 | Davis et al. | 70/279 |
| 4,995,248 | 2/1991 | Liu . | |
| 4,996,525 | 2/1991 | Becker et al. . | |
| 5,261,260 | 11/1993 | Lin . | |
| 5,386,713 | 2/1995 | Wilson . | |
| 5,421,178 | 6/1995 | Hamel et al. . | |
| 5,531,086 | 7/1996 | Bryant | 70/279 |
| 5,790,034 | 8/1998 | Khoury | 70/256 |
| 5,852,944 | 12/1998 | Collard, Jr. et al. | 70/278 |

FOREIGN PATENT DOCUMENTS

| | | |
|---|---|---|
| 4033840 | 4/1992 | Germany . |
| 2163579A | 2/1986 | United Kingdom . |

*Primary Examiner*—Darnell M. Boucher
*Attorney, Agent, or Firm*—Jackson Walker L.L.P.

[57] ABSTRACT

A kit for retrofitting a door with a remotely controllable locking mechanism having a combination key-operated deadbolt lock and door knob latching lock for a door. A housing for the operating parts is insertable in a mortised pocket or cavity in the latch edge of the door or it may be attached to the exterior surface of the interior well of the door. The electronics to operate the mechanism sends a signal to a receiver installable in the wall near the locks. Power is supplied to solenoids to simultaneously activate the locking and unlocking mechanisms of the deadbolt and the door knob latching lock when the kit is assembled in the door. Manual key overrides are provided for the deadbolt and for the latch.

9 Claims, 11 Drawing Sheets

KIT FOR RETROFITTING A DOOR WITH A SECURITY LOCK SYSTEM

This is a continuation-in-part application of Ser. No. 08/844,030, filed on Apr. 18, 1997, now U.S. Pat. No. 5,852,944 issued Dec. 29, 1998.

BACKGROUND OF THE INVENTION

1. Field of the Invention

Applicant's invention relates to a combination door locking system, and, more particularly, to a kit for retrofitting a door with a remotely controlled locking mechanism having a combination key-operated deadbolt lock and door knob latching lock. The kit may be externally mounted to the inside of the door, or fitted into a cut-out within the door shell.

2. Background Information

While remote control systems currently exist for locking and unlocking vehicles and, in some cases, locks on buildings and other structures, to date there has been no system to simultaneously lock/unlock a door having both a key-operated deadbolt lock and a door knob latching lock. Further, there has been no simple kit to convert an existing door locking system to provide for simultaneous operation of a deadbolt lock and a door knob latching lock. The present invention discloses such a kit.

U.S. Pat. No. 5,386,713 discloses a remote controlled car deadbolt lock. U.S. Pat. No. 5,261,260 discloses a remotely controlled door lock for a dog cage. Other locking mechanisms are shown in U.S. Pat. Nos. 4,509,093, 4,563,886, 4,685,709, and U.S. Pat. No. 4,996,525.

SUMMARY OF THE INVENTION

The present invention is a kit for retrofitting a door with a remotely controllable locking mechanism having a combination key-operated deadbolt lock and latching lock for a door. The locking mechanism includes a housing, a deadbolt operating mechanism attachable to an existing deadbolt lock in a door, a latch operating mechanism attachable to the existing door knob latching lock, and a remote control unit for a simultaneous activation of the deadbolt operating and latch operating mechanisms to lock and unlock the door. The locking mechanism may be supplied as a kit having these separate element or it may be largely pre-assembled in the housing and the housing mounted on the door surface on the interior side of the door. Further, the locking mechanism is provided with manual override capabilities.

DETAILED DESCRIPTION OF THE PREFERRED EMBODIMENT

Figure 1:
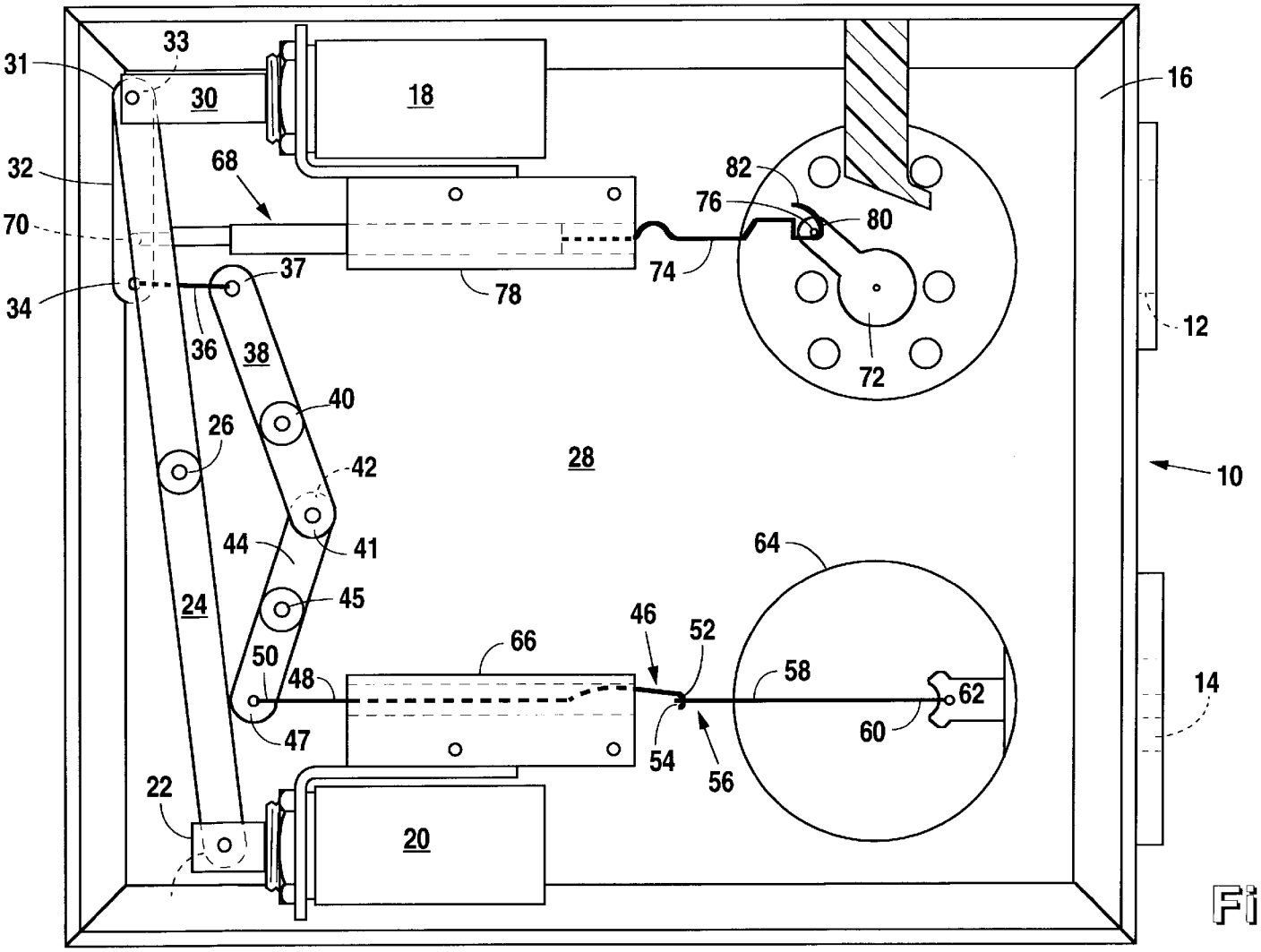
FIG. 1 illustrates the locking mechanism of the present invention in the unlocked position.

FIG. 1 illustrates the locking mechanism (10) of the present invention with both the conventional deadbolt lock (12) and the conventional door knob latching lock (14) in the unlocked or open position. The kit of the present invention is provided with an outer housing (16) which fits into a mortised pocket in the latch edge of the door. Because the housing containing the mechanism may be reversed top-to-bottom, and the latch may be reversed, one mechanism suffices for different arrangements. No major alternations to the door knob latching lock or deadbolt mechanism are necessary to accommodate the remotely controlled mechanism.

The mechanical operation of the locking mechanism (10) is illustrated in FIGS. 1–4. The remote control operation is illustrated in FIG. 5. As may be seen in FIG. 1, the arrangement provides two solenoids (18 and 20) for power. The electrical wiring is not shown but is fully understood by one of ordinary skill in the art. Solenoid (18) is the locking or closing solenoid. Solenoid (20) is the unlocking or opening solenoid.

In FIG. 1, the assembled kit shows that unlocking solenoid (20) has been pulled in by operation of a remote control unit (see FIG. 5). The retraction of the solenoid arm (22) causes pivoting lever (24) attached at end (25) to arm (22) to pivot about pivot connection (26). Pivot connection (26) allows the lever (24) to pivot and secures the lever to the housing wall (28).

Because locking solenoid (18) has been deactivated, its arm (30) moves to an extended position. End (31) of pivoting lever (24) is attached to solenoid arm (30). Thus, when the "open" command is given to the remote control controller and logic circuit (see FIG. 5), lever arm (24) is pivoted into the position shown in FIG. 1.

Extending downwardly from arm (30) of solenoid (18) is a bolting mechanism which includes a bolting lever (32). The top end (33) is attached to arm (30), while the lower end (34) is attached to a latch link wire (36). In the "open" position, bolting lever (32) pulls wire (36) attached to a first end (37) of a direction changing member including link (38) to cause link (38) to pivot about connection (40). Connection (40) pivotally affixes link (38) to the housing wall (28). The link (38) has a pivot ratio necessary to operate both the deadbolt and the latch, each with its own travel distance. The opposite end (41) of link (38) is pivotally attached to a latch operating mechanism including a first end (42) of a latching lever (44). Latching lever (44) is pivotally affixed to the housing wall (18) at connection (45). Lever (44) has a 1:1 pivot ratio. A latch pull arm (46) is attached to a second end

(47) of latching lever (44). In the "open" position, the above mentioned linkages cause the latch pull arm (46) to unlock the door knob latching lock (14).

Pull arm (46) has a pull extension member (48) attached at a first end (50) to the latching lever (44). The opposite end (52) is slidingly connected through a loop (54) in end (56) of a latch pull wire (58). The opposite end (60) of wire (58) is connected to the standard latching member (62) of the door knob latching lock (14). It is well known in the art that the latching member (62) is provided with internal springs to properly actuate the latching lock.

The latch pull wire (58) is made of a strong thin thread wire and is sized to fit between the knob mechanisms of the door knob which thrust into knob opening (64) in the door. The pull extension member (48) may be a wire or rod which passes through a guide (66) attached to the housing wall (28).

The opening of the deadbolt lock (12) shown in FIG. 1 is achieved when the opening solenoid (20) is pulled in and closing solenoid (18) is extended. A bolt arm (68) is attached to a generally mid-portion (70) of the bolting lever (32). The other end of the bolt arm (68) is attached to the standard rotation member (72) of the deadbolt lock (12). The bolt arm (68) has a spring member (74) which fits around an attachment pin (76) in the rotation member (72). Movement of arm (68) causes the rotation member to move from the locked to unlocked position. Arm (68) is provided with a guide (78) which is attached to the housing wall (18).

Figure 2:
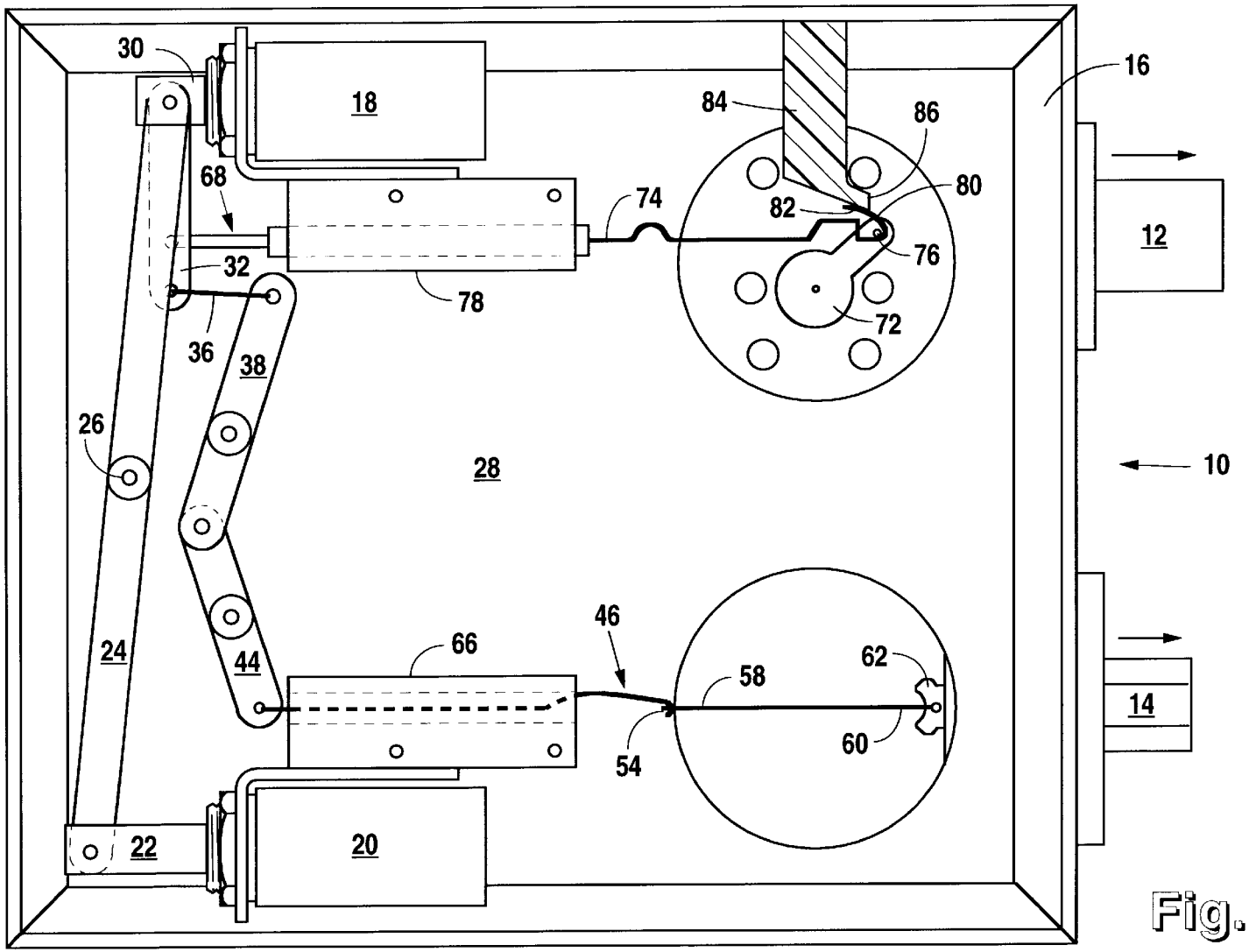
FIG. 2 illustrates the locking mechanism of the present invention in the locked position.

Turning now to FIG. 2, the locking mechanism (10) is shown in the locked or closed position. By operation of the remote control unit, closing solenoid (18) is activated, retracting arm (30) causing the pivoting lever (24) to rotate about pivot (26). Bolting lever (32) is moved to the right causing bolt arm (68) to shift in guide (78). Spring member (74) shifts to the right causing rotation member (72) to rotate the deadbolt lock (12) into the locked or closed position.

It will be noted that spring member (74) is provided with ahead portion (80) having an arcuate retainer (82). The head portion moves against the pin (76) to cause the rotation. The arcuate retainer (82) passes under bolt arm wedge (84) and is held in the closed position by wedge toe (86).

FIG. 2 also illustrates that as solenoid (18) is activated and solenoid (20) is deactivated, arm (22) is extended and lever (24) pivots, bolting lever (32) shifts to the right and wire (36) also shifts to the right. As previously stated, latching member (62) is provided with internal springs which cause the member (62) to retract and the latch lock (14) to extend into the locked position. Because tension is released at wire (36) by the movement of bolting lever (32), direction changing link (38) and latching lever (44) pivot as a result of the urging of the springs in the latch member (62). Latch pull wire (46) shifts to the right and remains in loop (54). Latching lock (14) moves to the locked, or closed, position.

At this point, it should be explained that operation of the standard door knob assembly pulls the latching member (62) to release the door latch. By manually locking the knobs, latching marker (62) will remain in the locked position. However, even if the knob is manually locked, activation of the unlocking solenoid (20) results in the displacement of the latching member (62) as described above and the door may be opened.

Figure 3:
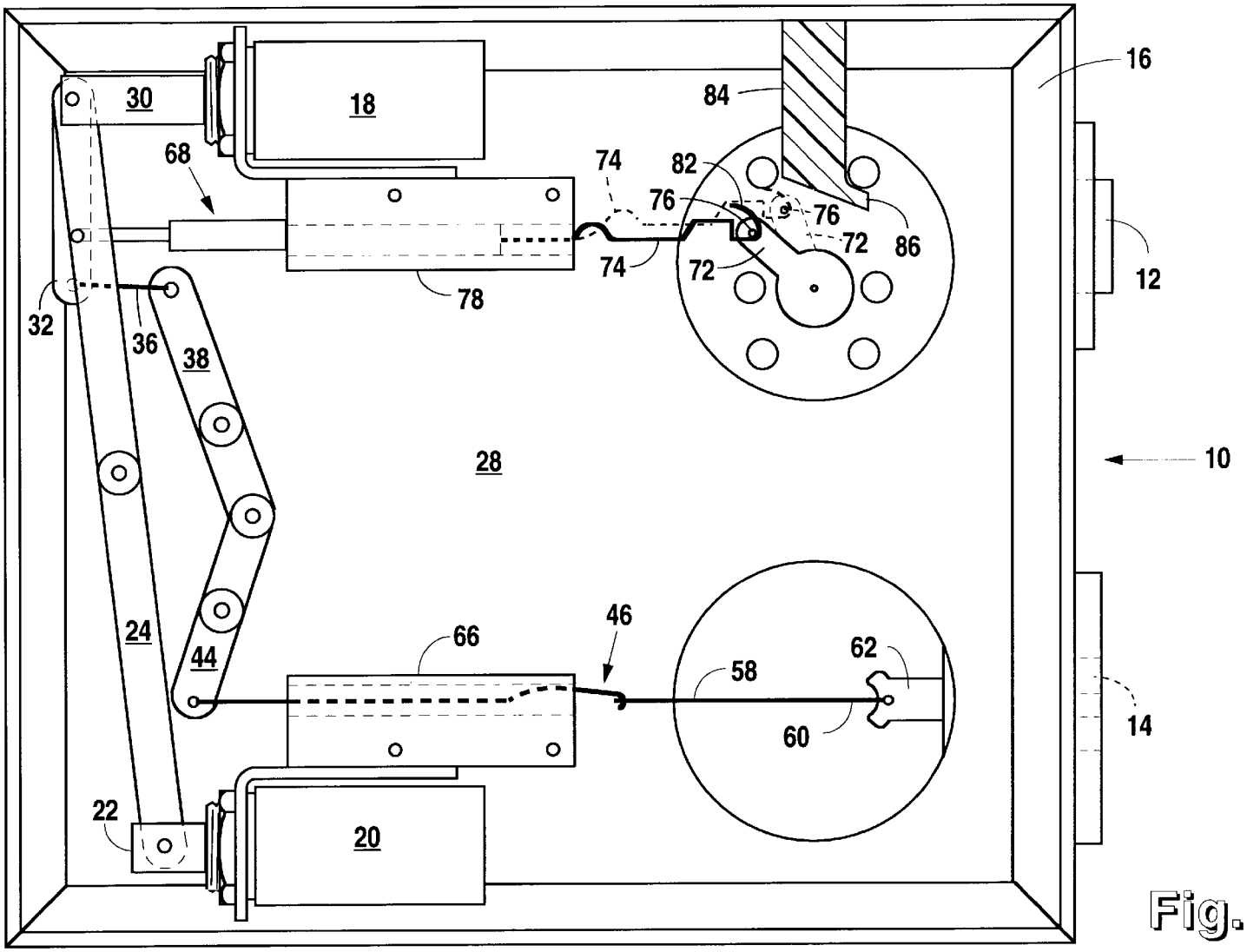
FIG. 3 illustrates the locking mechanism of the present invention in transition from an unlocked deadbolt to a locked deadbolt.

FIG. 3 illustrates the transition of the locking mechanism (10) from the unlocked to locked position. It may be seen that spring member (74) pushes against pin (76) causing the rotation member (72) to move toward the locked position. Arcuate retainer (82) moves under bolt arm wedge (84) until it held under wedge toe (86) as shown in FIG. 2.

Figure 4:
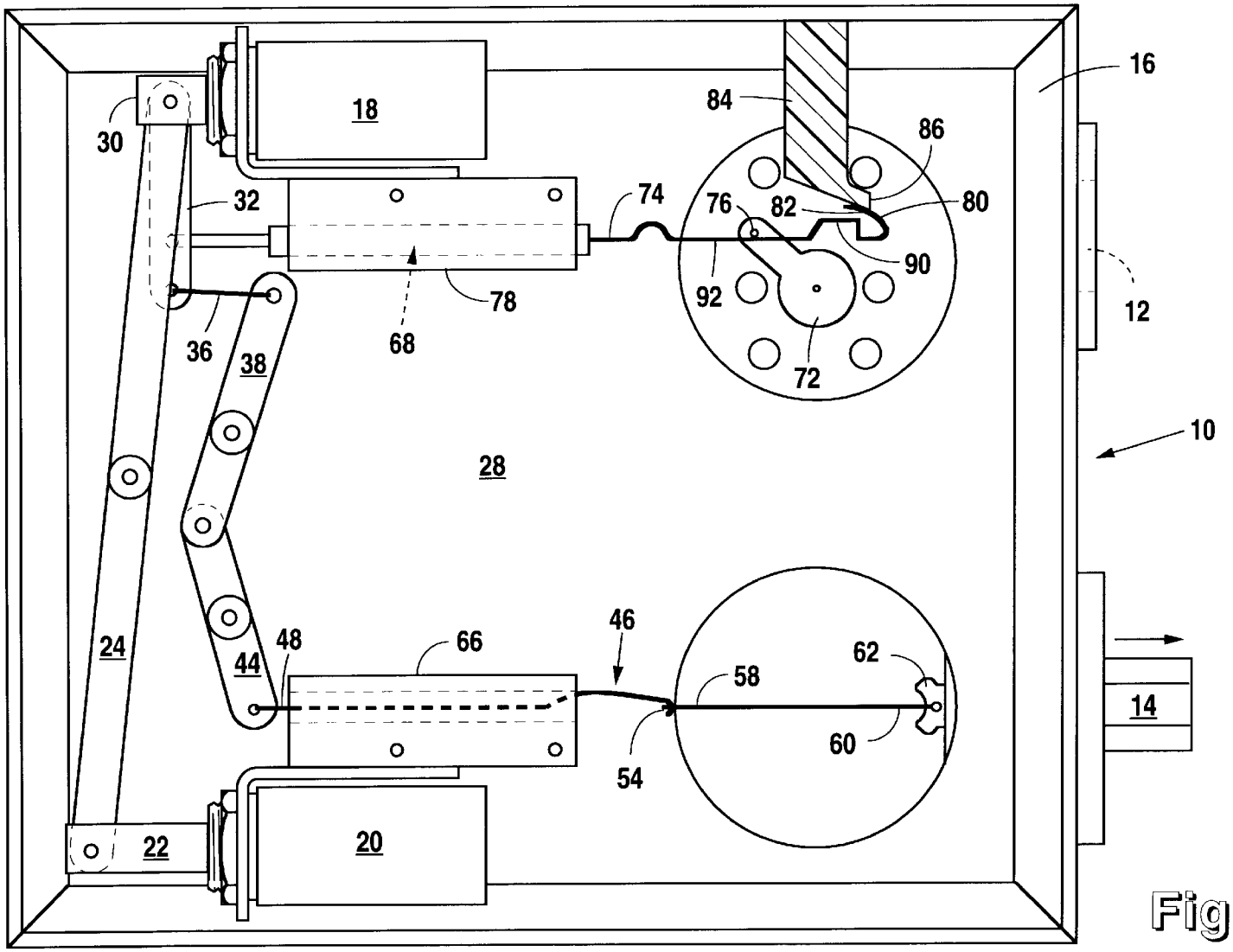
FIG. 4 illustrates the deadbolt override feature of the present invention.
Figure 5:
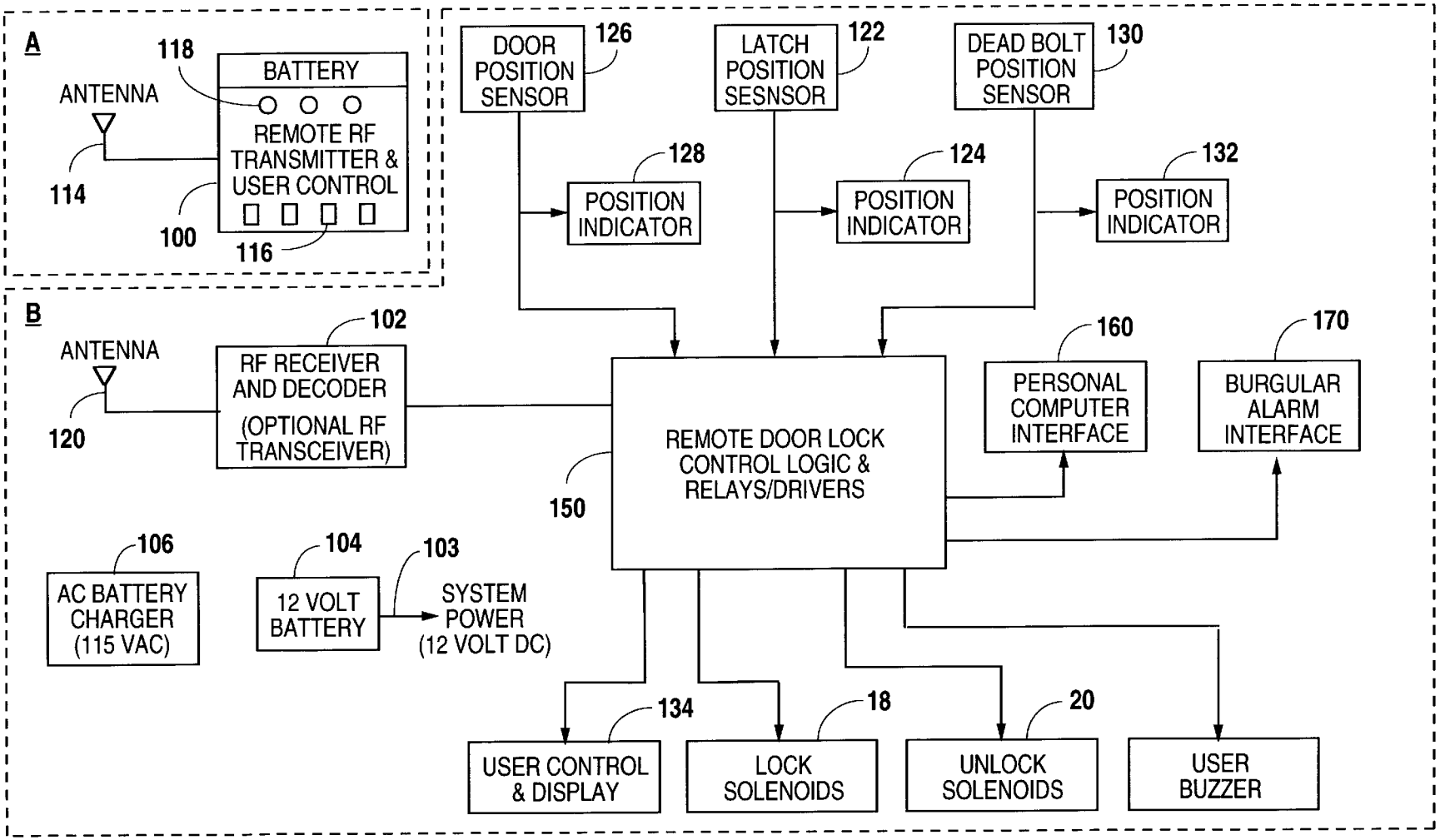
FIG. 5 is a schematic of the electronic controls of the present invention.

FIG. 4 illustrates the deadbolt override feature of the present inventive locking mechanism (10). It should be understood by looking at FIG. 4 that the locking solenoid (18) has been activated, yet it may be seen that the rotation member (72) and deadbolt lock (12) are in the unlocked position. This has been achieved by the operator manually rotating the rotation member (72) by an exterior key well known in the art. In FIG. 4, the lock pin (76) has rotated out of head (80). If the head (80) were not held under toe (86), the rotation of the key in the deadbolt lock would attempt to move the spring member (74) upwardly and back toward an unlocked position resulting in possible jamming of the lock mechanism and putting the latch in the open position. By holding head (80) in position, the pin (76) moves over shoulder portion (90) and back down on flat section (92). Thus, the deadbolt lock has been unlocked, while the knob latching lock (14) is still in the locked position.

Further, it may be noted in FIG. 4 that when the remote control unit is actuated to unlock the mechanism (10), spring member (74) will be pulled to the left, pin (76) will ride up the tapered shoulder (90) and back into the head (80).

By manually unlocking the knob latching lock (14) as discussed above, the latch pull extension (48) slides through the loop (54) in the latch pull wire (58). Again, even though the remote control unit is activated to lock both locks, the knob latching lock may be overridden. Extension (48) simply slides through the loop (54) and the locking mechanism (10) is not jammed.

It should be understood that an alternative arrangement may be used to move the latching lock and deadbolt lock that would include motors and worm gears in place of the solenoid levers and links.

The electronics to operate the mechanical parts are illustrated in FIG. 5. A signal is sent from the remote transmitter (100) (shown in box A of FIG. 5) carried on the person. The transmitter (100) may be replaced with an optional radio frequency (RF) transceiver and user control display. The receiver (102) (shown in box B of FIG. 5) is located near a power supply (104) installed in the wall adjacent the locks. Power is 12-volt direct current (DC) supplied through wires (103) which enter the housing (16) via a hole (not shown) in the back of the housing (16).

The wires (103) enter the door from the wall via a coiled spring which shields the wires (103) when the door is open. The coiled spring is in the hinge side of the door. The wires (103) pass through a drilled hole to the mortised cavity or pocket in the door holding the housing (16). A battery (104) on a constant trickle charge (106) from house alternating current provides the power to the solenoids (18 and 20).

A general description of the remote control operation may be understood by viewing FIG. 5.

The remotely controlled door lock system (10) consists of two major subsystems; namely, a remote controller (box A), and a door lock controller (box B). The remote controller (box A) consists of the following major components: battery (110), RF transmitter (112), RF antenna (114), user control switches (116), and user indicators (118). The door lock controller (box B) consists of the following major components: RF receiver (102), RF antenna (120), alternating current (AC) powered battery charger (106), 12-volt battery (104), latch position sensor (122) and indicator (124), deadbolt position sensor (126) and indicator (128), door position sensor (130) and indicator (132), user control indicator (124), lock solenoid (18), and unlock solenoid (20).

The remote controller RF transmitter (112) is used to transmit an identification number and a "lock" or "unlock"

command to the door lock controller (box B). The RF receiver and decoder (102) processes the signal and passes it to the control logic (150). The control logic (150) then processes the information and commands to validate the remote controller (box A) and operate the door lock solenoids (18 and 20). The control logic (150) utilizes a micro-controller to process the remote control signals and to controls relays which in turn power the door lock solenoids (18 and 20). A 12-volt battery (104) is sued to supply power to the door lock controller (box B). A battery charger (106) is used to maintain battery charge. This charger (106) is powered by the utility power available at the installation site. Indicators are used to indicate the latch position and the deadbolt position. The position information can be obtained directly (optimal) via mechanical or optical switches or indirectly via electronic control signals. The door lock controller sensors and optionally the applicable indicators, and the door lock solenoids are mounted in the door. All other door lock controller components are mounted in convenient locations within the walls and attic spaces surrounding the door.

Many design and functional variations are available to the basic design. For instance, the remote controller might also employ an RF receiver, thus enabling door lock controller information to be displayed remotely to the user. Such information might include the door position and each of the door lock positions. Other controls might also be added to the remote controller. These might include lighting control, garage door control, security system control, or remote lock/unlock disable control. Additionally, technologies other than RF might be used for enabling the communications between the remote control and the door lock controller. Such technology might be infrared, laser, ultrasonics, or microwave.

The door lock controller might provide an interface capability to a personal computer (160), a security system (170) such as a monitor and access control system or even a simple burglar alarm. Additional sensor inputs might be added enabling video camera operation or visitor/intruder detectors such as pressure sensitive pads. Optional local user controls might be employed to allow enhancements or discriminating product features such as a local switched lock/unlock control. Remote control security can be enhanced using various encryption schemes as time-based coding, challenge-and-response, rolling-code encryption or future algorithms unknown today. Optional local user indicators, displays, or audible tones might be added to provide such information as system power status, battery charge status, door lock/unlock solenoid activation, or even visitor/intruder presence.

In operation, a fixed code transmitter (100) with over 60,000 possible security codes and a range of approximately 150 feet is used to transmit a command to lock or unlock the door. The user initiates the sending of the command by pushing a button switch (116) on the remote control. The same push button is used to both lock and unlock the door. Alternatively, separate push buttons could be used. Using the single button design, pressing the button will cause the lock solenoid to energize if "unlock" occurred previously, and likewise, if a "lock" had occurred previously, then the unlock solenoid will be energized. A light emitting diode indicator (118) is used to show the user that transmitter activation has occurred while depressing the lock/unlock push button switch.

The RF receiver (102) located within the door lock controller receives the transmission from the remote control and passes the security code and switch command to the micro-controller. The micro controller then determines if the command received is valid and determines the command activated. The micro controller will then energize either the lock relay or the unlock relay based upon the prior state. In turn, the energized lock relay will energize the lock solenoid or the unlock relay will energize the unlock solenoid. A light emitting diode will be turned off if the door unlock relay was last energized and will blink on and off periodically if the lock relay was last energized. Alternatively, steady state indicators could be used to indicate actual deadbolt and latch lock positions. In this case, a mechanical, optical, or perhaps proximity switch could be used to sense the lock position.

The device may use an Intel® 8031 micro controller as the system controller. Alternatively, programmable logic devices and other types of micro controllers or microprocessors and even simple sequencing logic would be used to control the door lock system. The choice of device depends upon the functional and operational requirements of the product model. Currently, many semi-conductor manufacturers are introducing new devices specialized in keyless and wireless entry systems. Representative manufacturers include National Semiconductor®, Excel®, Motorola®, and Microchip Technology®. These devices target both the system control and the system security.

During system installation, the RF receiver (102) is programmed with the security code of the RF transmitter (100) to be used. The RF receiver (102) may be programmed (or trained) to accept acknowledged multiple transmitter codes.

The door lock controller (box B) components are powered by a 12 volt, 4.5 ampere hour sealed lead acid battery (104). The battery (104) provides the surge current required during solenoid activation. A 12 volt DC battery charger (106) is used to continuously "trickle" charge the battery and thus maintain the battery charge level.

An alternative embodiment of the door kit is shown in FIGS. 6–13. The kit may be assembled on the exterior surface of the interior wall of the door. Connections are necessary to extend through the interior wall of the door from the inside of the kit housing to actuate and deactuate the deadbolt and the door latch in a way similar to that discussed above with FIGS. 1–5. The manual overrides discussed above apply to the FIGS. 6–13 embodiments.

Figure 6:
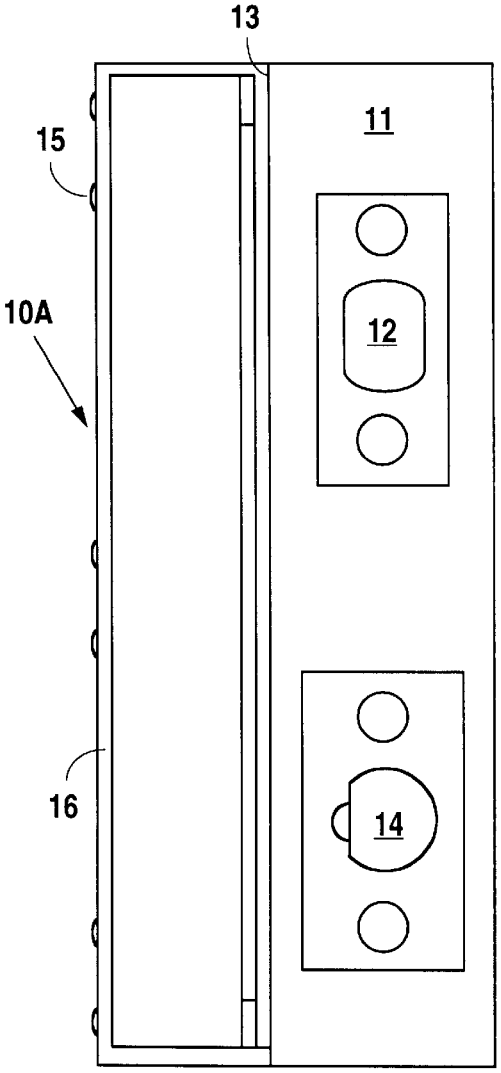
FIG. 6 is a door front-end view showing the kit attached to the exterior surface of the interior wall of the door.
Figure 7:
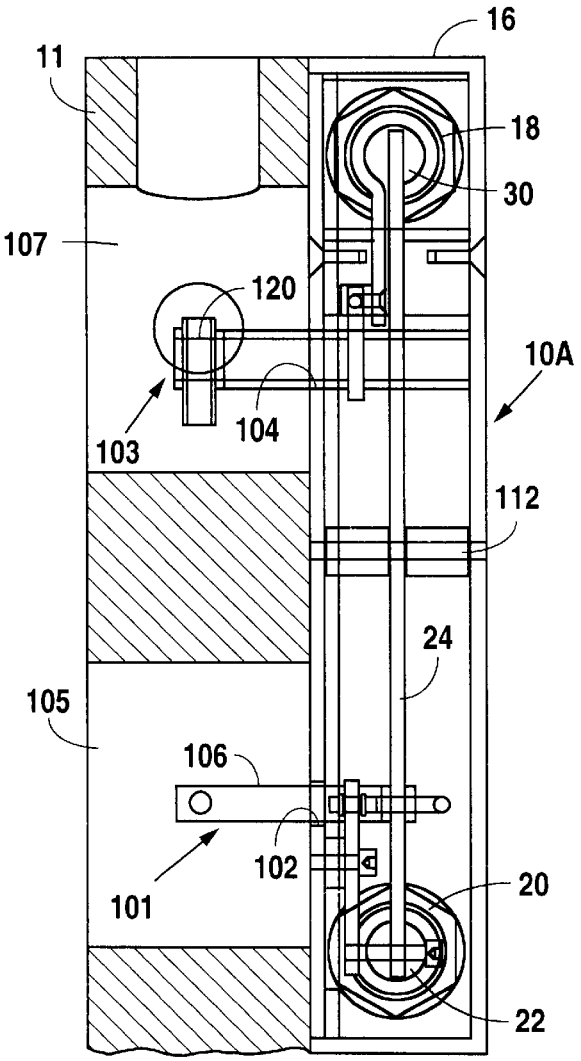
FIG. 7 illustrates a cross-sectional, door hinge-end view of the kit attached to the exterior surface of the interior wall of the door with the necessary connectors.
Figure 10:
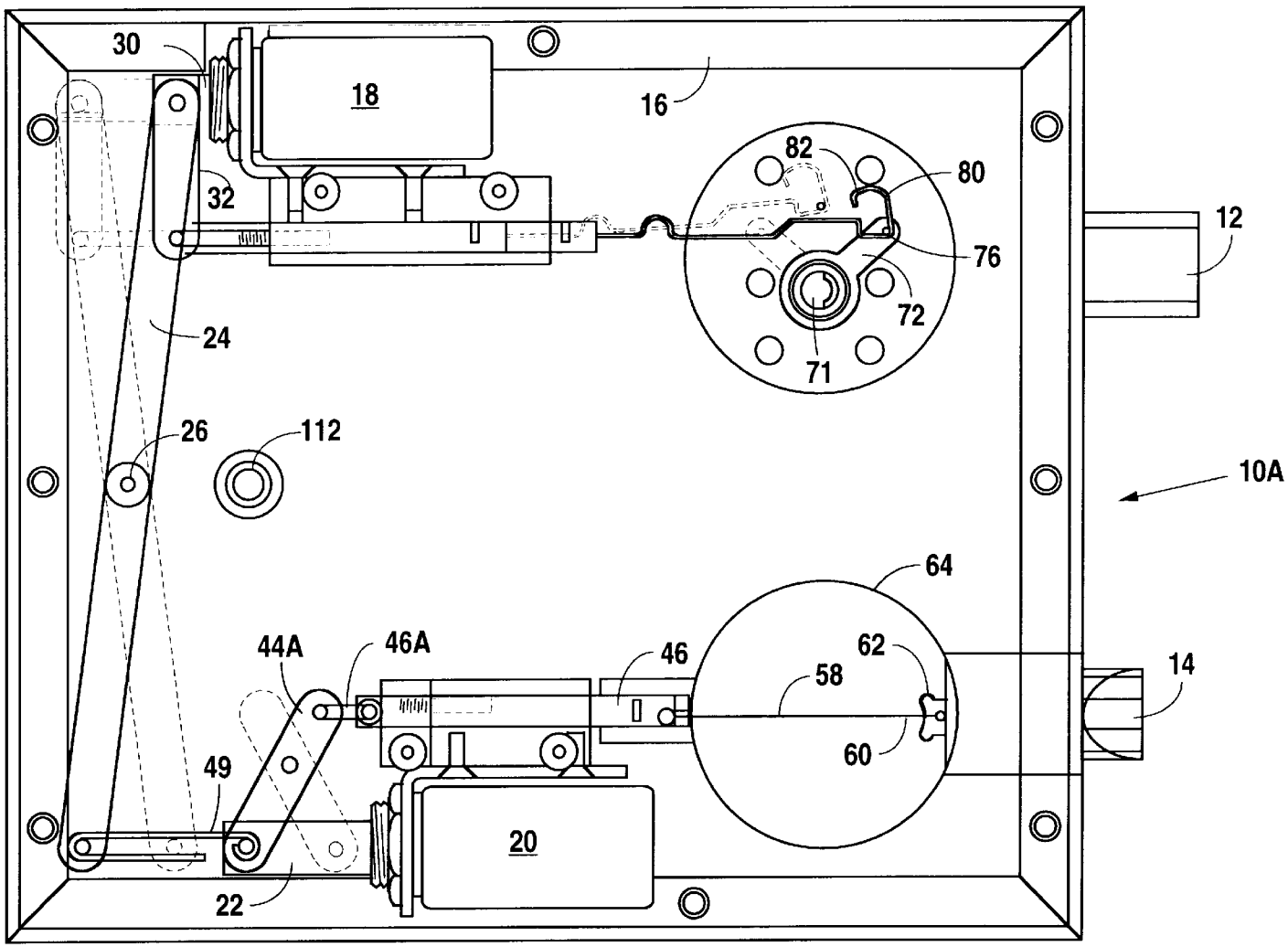
FIG. 10 shows a side view of the assembled kit illustrating the dual action of the device.
Figure 11:
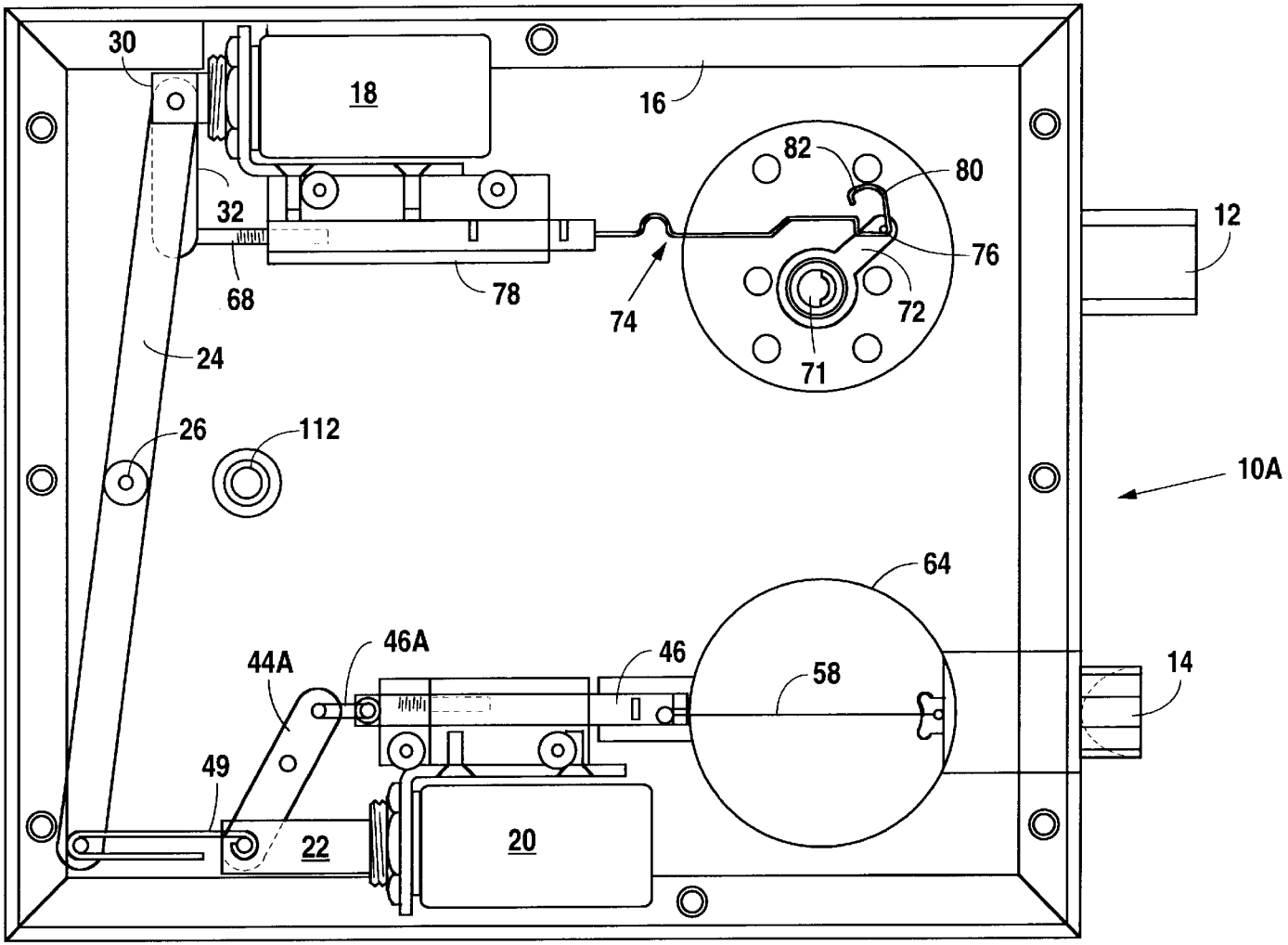
FIG. 11 illustrates a side view of the assembled kit showing both the deadbolt and the door latch extended.

FIG. 6 shows a front-end (or latch end) view of the door (11) which houses a conventional deadbolt locking mechanism (12) and a conventional door knob latching lock (14). The kit (10A) is attached to the exterior surface (13) of the interior wall of the door by extended screws of fasteners (15). The screws pass through the kit housing (16) and are anchored to the interior wall of the door. FIG. 7 illustrates a partial cross-sectional hinge-end view of the kit (10A) with the connections (101) and (103) extending from inside the kit housing (16), through openings (102) and (104) in the door (11), into pockets (105) and (107) inside the door (11) structure. Additionally shown in FIG. 7 are the locking or closing solenoid (18) with solenoid arm (30), the unlocking or opening solenoid (20) with solenoid arm (22), and pivoting lever (24). These are the same structures as discussed above. The retraction of solenoid arm (22) causes pivoting lever (24) attached at end (25) of arm (22) to pivot about pivot connection (26) (FIG. 10). Pivot connection (26) allows the lever (24) to pivot and secures the lever (24) to the kit housing wall (28) (FIG. 10).

Figure 8:
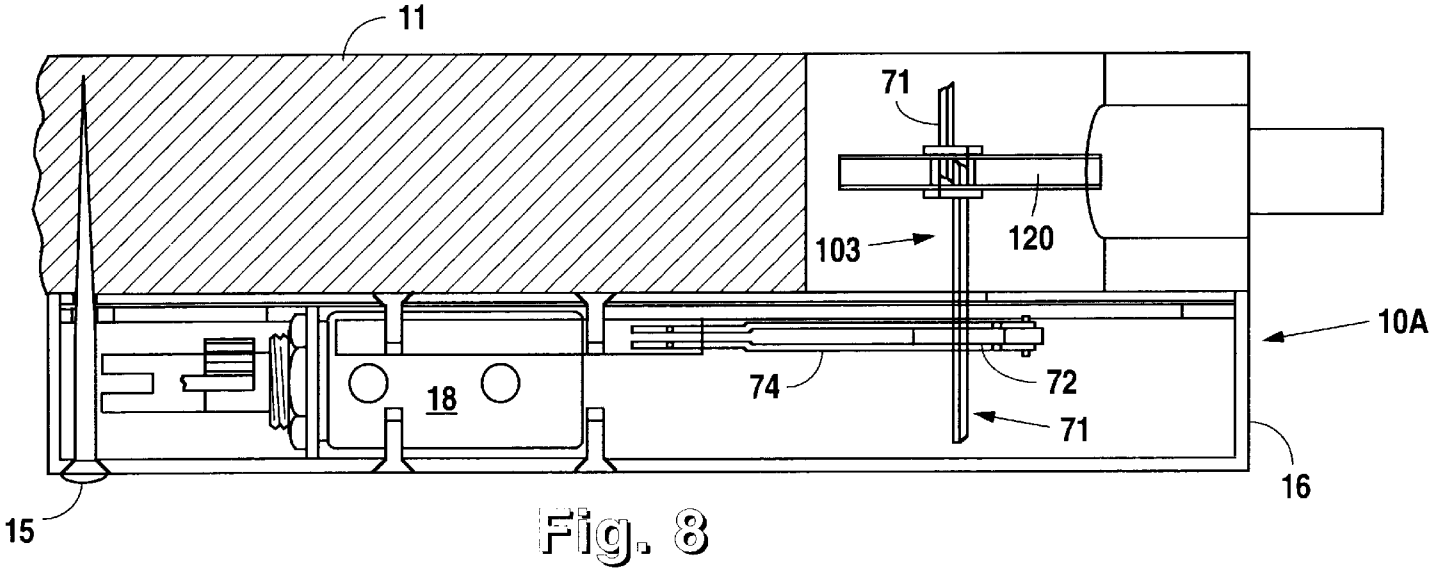
FIG. 8 is a partial top door end view of the kit attached to the exterior surface of the interior wall of the door with the dead-bolt extended.
Figure 9:
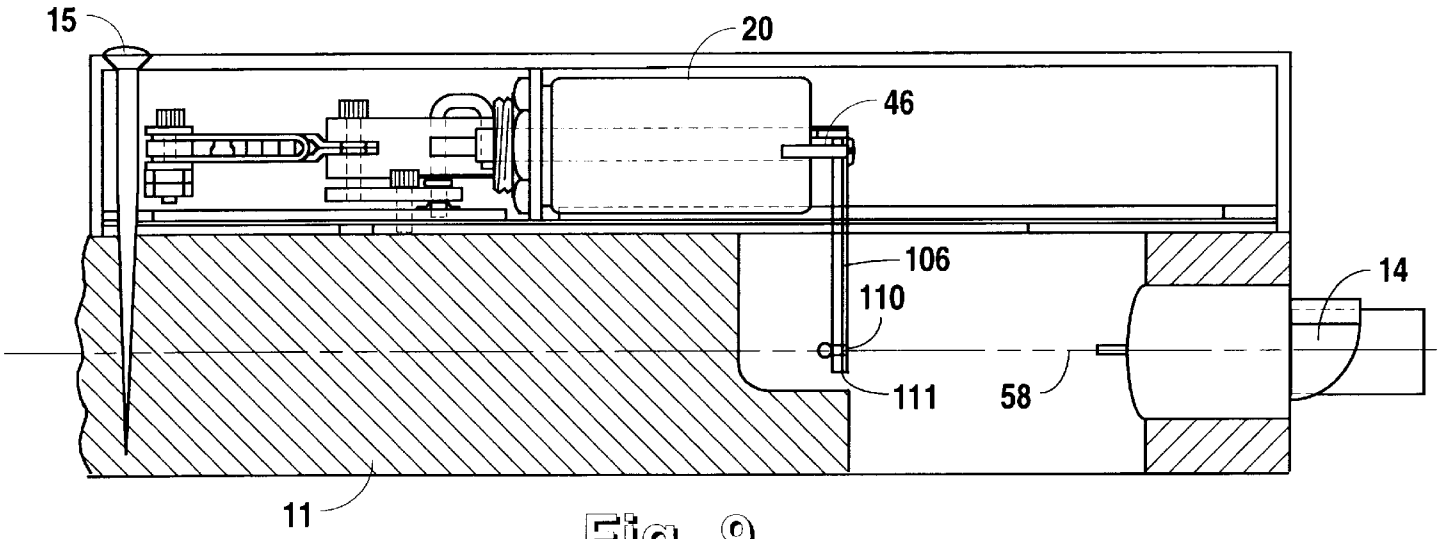
FIG. 9 is a partial bottom door end view of the kit attached to the exterior surface of the interior wall of the door with the door latch extended.

Returning to connection (101), it may be seen in FIG. 9 that a wire pull rod (106) extends generally perpendicularly from latch pull arm (46) which is linked to the opening solenoid (20). The pull rod (106) has an opening (110) in a distal end (111) which receives and retains a latch pull wire (58). The way the latch (14) operates is discussed above. In FIG. 8, connection (103) may be seen. A rotation or turn coupling (71) extends generally perpendicularly from conventional dead bolt and withdrawal mechanism (120), through the door wall into the kit housing (16) attaching to rotation member (72) in the housing. By the operation of solenoid (18), spring member (74) causes the rotation member (72) to rotate as discussed above.

FIG. 10 illustrates the dual operation of the assembled kit attached to the outside surface of the door's interior wall. The dotted lines show the position of the kit elements with the deadbolt (12) and door knob latch (14) withdrawn. The solid lines show both locked. The electrical wiring (not shown) necessary to activate the solenoids enters the inside of housing (16) through access hole (112).

The pivot linkage of the embodiment of kit (10A) is slightly different than that shown in FIGS. 1–5, FIG. 11 shows both the deadbolt (12) and door knob latch (14) extended or in the locked position. This is similar to FIG. 7. Solenoid (18) has been activated, retracting or pulling arm (30) and extending arm (22). Lever (24) rotate about pivot (26). Bolting lever (32) is moved to the right causing bolt arm (68) to shift in guide (78). Spring member (74) shifts to the right causing rotation member (72) to rotate. The rotation of member (72) causes the turning coupling (71) to extend the deadbolt (12). Turning to the operation of solenoid (20) in FIG. 11, it may be seen that it is deactivated, and arm (22) is extended, latching lever (44A) pivots allowing latch pull arm (46) to move to the right as latch pull wire (58) connecting the latching member (62) is pulled by the standard latching mechanism.

Figure 12:
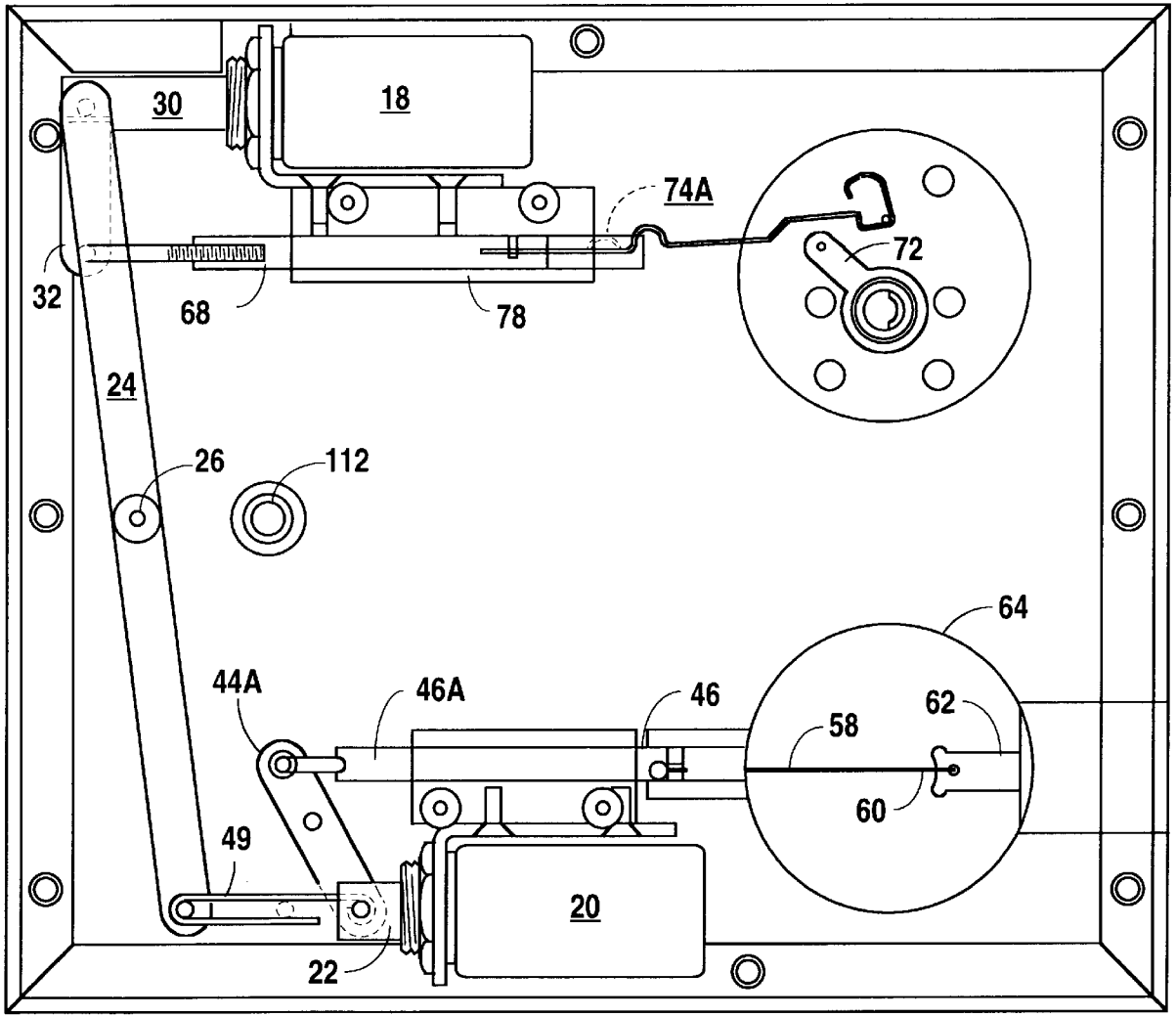
FIG. 12 shows a side view with both the deadbolt and the door latch withdrawn.

It will be noted in FIG. 12 that upon activation of the system as described above, both the dead bolt (12) and the door knob latch (14) may be unlocked or withdrawn. Solenoid (20) is activated rotating latching lever (44A) and pulling wire (58) and latching member (62). Further, as arm (22) is retracted latch clip (49) pulls on lever (24) causing it to rotate. Solenoid (18) is deactivated extending arm (30), moving bolting lever (32) to the left causing bolt arm (68) to shift in guide (78). Spring member (74) shifts to the left causing rotation member (72) to open the deadbolt (12). The dotted line at (74A) shows the position of the spring (74) in the full open position as discussed in the embodiment of FIGS. 1–5.

Figure 13:
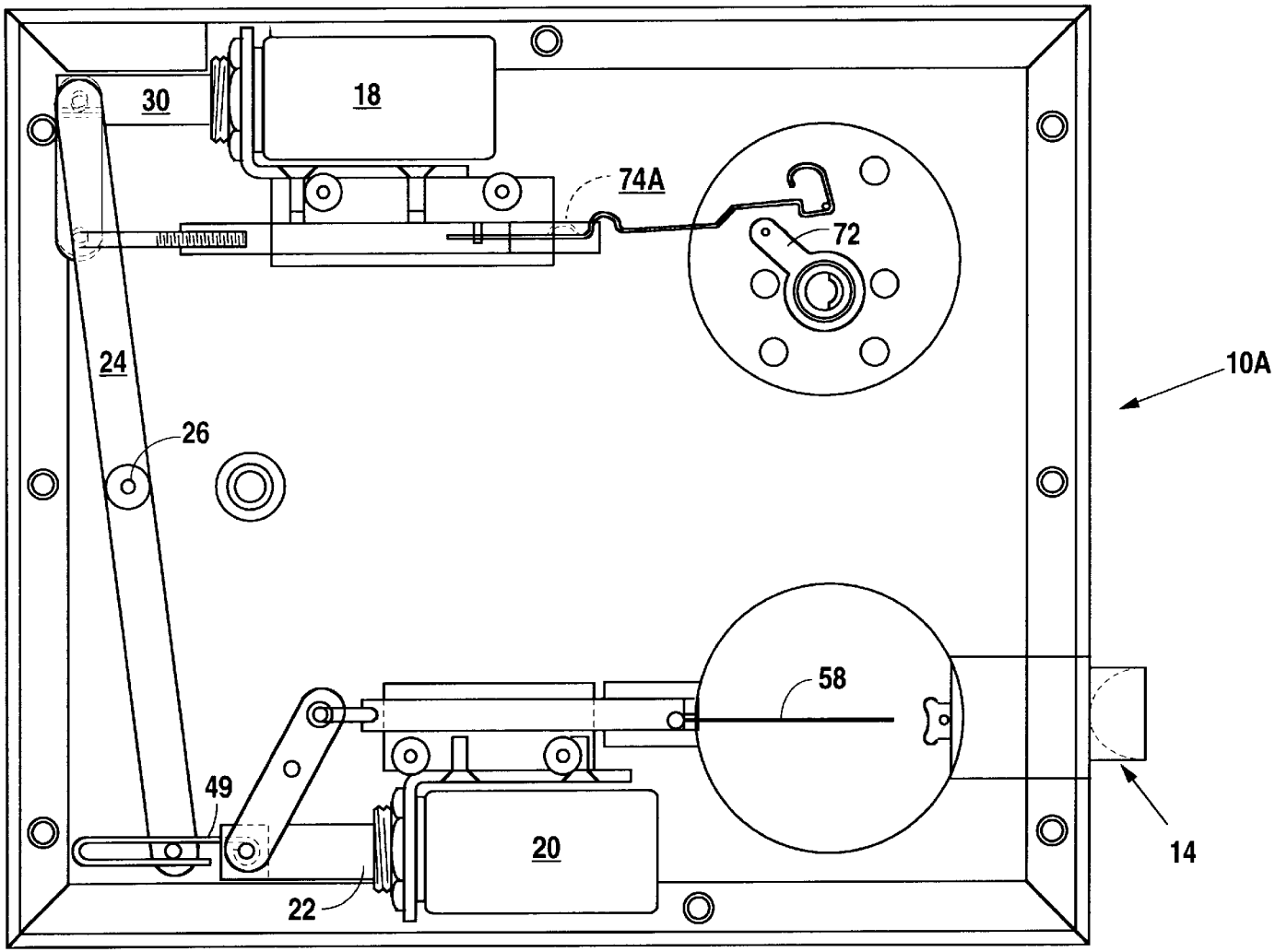
FIG. 13 shows a side view with the deadbolt withdrawn and the door latch extended.

FIG. 13 illustrates the kit (10A) about 3 seconds after the configuration of FIG. 12. After both the knob latch and the dead bolt are open, a time delayed circuit allows for the latch solenoid (22) to deactivate causing the latch to engage the door to keep it shut. This is shown in FIG. 13. If the manual knob latch is not locked, the operator will be able to open the door by turning the knob.

In some circumstances a person may want to retrofit an existing door having a conventional door knob latching lock having a latching member to accept or accommodate a dead bolt lock having a bolt rotation member as part of the present inventive kit. In such cases, the kit will include the deadbolt mechanism including the rotation member added to the kit.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A kit for retrofitting a door having an existing deadbolt lock having a bolt rotation member and door knob latching lock having a latching member comprising:

a housing;

a deadbolt operating mechanism attachable to said deadbolt lock, said deadbolt operating mechanism further comprising:

a first locking solenoid mountable within said housing;

a second unlocking solenoid mountable within said housing;

a pivoting lever attachable at a first end of said first locking solenoid, attachable at a second end to said second unlocking solenoid, and further attachable to said housing;

a bolting mechanism attachable at a first end to said first locking solenoid and adapted to be attachable to said bolt rotation member;

a direction changing member attachable at a first end to said bolting mechanism and attachable to said housing;

a latch operating mechanism attachable to said housing and further attachable at a first end to a second end of said direction changing member, said latch operating mechanism adapted to be attachable to said latching member of said latching lock;

means for mounting said housing to said door; and a remote control unit for activating said first locking solenoid and said second unlocking solenoid to lock and unlock said deadbolt lock and said latching lock when said kit is attached thereto.

2. The kit of claim 1 wherein said bolting mechanism further comprises:

a bolt arm adapted to be attached to said bolt rotation member and a spring member attachable to a second end of said bolt arm between said bolt rotation member and said bolt arm.

3. The kit of claim 2 wherein said latch operating mechanism further comprises:

a latch pull extension attachable at a first end to a latching lever and slidingly connectable at a second end to a pull loop in a latch pull wire adapted to be attachable to said latching member of said latching lock.

4. The kit of claim 3 further comprising:

a bolt arm guide attachable to said housing; and a latch pull arm guide attachable to said housing.

5. The kit of claim 2 further comprising:

a bolt arm wedge affixable to said housing and cooperating with said bolt arm to enable said deadbolt lock to be unlocked with a key without remote activation of said solenoids.

6. The kit of claim 1 further comprising:

a first connector extending from said bolt rotation member through a first opening in said door to rotate said bolt rotation member;

a second connector extending from said latching member through a second opening in said door to pull said latching lock; and means for attaching said housing to an exterior surface of an interior wall of said door.

7. A kit for retrofitting a door having an existing deadbolt lock having a bolt rotation member and door knob latching lock having a latching member comprising:

a housing;

a deadbolt operating mechanism attachable to said deadbolt lock, said deadbolt operating mechanism further comprising:

a first locking solenoid mountable within said housing;

a second unlocking solenoid mountable within said housing;

a pivoting lever attachable at a first end of said first locking solenoid, attachable at a second end to said second unlocking solenoid, and further attachable to said housing;

a bolting mechanism attachable at a first end to said first locking solenoid and adapted to be attachable to said bolt rotation member;

a latch operating mechanism attachable to said housing and further attachable at a first end to a second solenoid, said latch operating mechanism adapted to be attachable to said latching member of said latching lock;

means for mounting said housing to said door; and a remote control unit for activating said first locking solenoid and said second unlocking solenoid to lock and unlock said deadbolt lock and said latching lock when said kit is attached thereto.

8. The kit of claim 7 further comprising:

a first connector extending from said bolt rotation member through a first opening in said door to rotate said bolt rotation member;

a second connector extending from said latching member through a second opening in said door to pull said latching lock; and means for attaching said housing to an exterior surface of an interior wall of said door.

9. A kit for retrofitting a door having a door knob latching lock having a latching member comprising:

a housing a deadbolt lock having said bolt rotation member;

a deadbolt operating mechanism attachable to said deadbolt lock, said deadbolt operating mechanism further comprising:

a first locking solenoid mountable within said housing;

a second unlocking solenoid mountable within said housing;

a pivoting lever attachable at a first end of said first locking solenoid, attachable at a second end to said second unlocking solenoid, and further attachable to said housing;

a bolting mechanism attachable at a first end to said first locking solenoid and adapted to be attachable to said bolt rotation member, a latch operating mechanism attachable to said housing and further attachable at a first end to a second solenoid, said latch operating mechanism adapted to be attachable to said latching member of said latching lock;

means for mounting said housing to said door; and a remote control unit for activating said first locking solenoid and said second unlocking solenoid to lock and unlock said deadbolt lock and said latching lock when said kit is attached thereto.

* * * * *